US007648299B2

(12) United States Patent
Geithner et al.

(10) Patent No.: US 7,648,299 B2
(45) Date of Patent: Jan. 19, 2010

(54) WRITING IMPLEMENT WITH A CAP THAT CAN BE SCREWED ON

(75) Inventors: Helmut Geithner, Wittenförden (DE); Bodo Hinsch, Hamburg (DE)

(73) Assignee: Montblanc-Simplo GmbH, Hamburg (DE)

( * ) Notice: Subject to any disclaimer, the term of this patent is extended or adjusted under 35 U.S.C. 154(b) by 0 days.

(21) Appl. No.: 11/988,448

(22) PCT Filed: Jun. 23, 2006

(86) PCT No.: PCT/EP2006/006090

§ 371 (c)(1),
(2), (4) Date: Jan. 18, 2008

(87) PCT Pub. No.: WO2007/006405

PCT Pub. Date: Jan. 18, 2007

(65) Prior Publication Data

US 2008/0286033 A1 Nov. 20, 2008

(30) Foreign Application Priority Data

Jul. 12, 2005 (DE) ..... 10-2005-032-548

(51) Int. Cl.
*B43K 23/12* (2006.01)

(52) U.S. Cl. ..... 401/243; 401/247

(58) Field of Classification Search ..... 401/243–247, 401/202, 213
See application file for complete search history.

(56) References Cited

U.S. PATENT DOCUMENTS

| | | | | | |
|---|---|---|---|---|---|
| 1,075,631 | A | * | 10/1913 | Dods | 401/246 |
| 2,320,936 | A | * | 6/1943 | Kessler | 401/165 |
| 3,547,552 | A | | 12/1970 | Rösler | |
| 4,380,403 | A | * | 4/1983 | Endres et al. | 401/213 |
| 4,780,016 | A | | 10/1988 | Kim | |
| 5,336,011 | A | * | 8/1994 | Ferguson et al. | 401/247 |

FOREIGN PATENT DOCUMENTS

| | | |
|---|---|---|
| DE | 328203 | 10/1920 |
| DE | 101 41 488 | 3/2003 |

OTHER PUBLICATIONS

International Search Report mailed Dec. 7, 2006.

* cited by examiner

*Primary Examiner*—David J Walczak
(74) *Attorney, Agent, or Firm*—Nixon & Vanderhye P.C.

(57) ABSTRACT

A writing implement includes a shaft part that holds a stylus and a cap, which can be screwed onto the shaft part in order to cover the stylus from an initial position of engagement up to a final position. A resistance against the screwing on, which is greater than the resistance when screwing on from the initial position of engagement up to an intermediate position, acts upon the cap when screwing on the cap from the intermediate position, which is located between the initial position of engagement and the final position, until reaching the final position.

6 Claims, 3 Drawing Sheets

WRITING IMPLEMENT WITH A CAP THAT CAN BE SCREWED ON

This application is the U.S. national phase of International Application No. PCT/EP2006/006090 filed 23 Jun. 2006 which designated the U.S. and claims priority to German Patent Application No. 10 2005 032 548.3 filed 12 Jul. 2005, the entire contents of each of which are hereby incorporated by reference.

The invention relates to a writing implement having a shaft part, on which a writing tip is mounted, and a cap that can be screwed onto the shaft part from a first engaged position to an end position, for covering the writing tip.

A vast variety of shapes of writing implements of this kind are known, in particular those in the form of a fountain pen. In the case of these, the cap is screwed onto the shaft part for the purpose of protecting the writing implement, in order to protect the writing tip from damage and, in particular in the case of fountain pens, to prevent the writing fluid from drying up. Moreover, covering the writing tip by means of the screwed-on cap makes it possible to put the writing implement in a jacket pocket or the like without any risk that the garment will be soiled.

So that the cap fulfills its sealing function, the user should always screw it onto the shaft part as far as the end position. However, sometimes the user screws the cap onto the shaft part only part-way, with the result that there is a risk on the one hand that it is not covered in a sealed manner and on the other that the risk of the cap coming off by itself is not ruled out. The latter may occur even if the cap is screwed on as far as the end position if the friction created by the engagement of the thread is not sufficient to hold the cap reliably in place. On the other hand, too great a friction when the cap is screwed on entails a risk that the user stops screwing it on too soon.

It is an object of the invention to improve a writing implement such that when the user screws on the cap he or she receives an indication that the cap is approaching its screwed-on end position, and that the cap is held reliably in this end position.

This object is achieved according to the invention by a writing implement of the type mentioned at the outset in that when the cap is screwed on there is a resistance to screwing on the cap from an intermediate position, which is located between the first engaged position and the end position, until the end position is reached, this resistance being greater than the resistance when it is screwed on from the first engaged position to the intermediate position.

Thus, in the case of the writing implement according to the invention, the cap is screwed onto the shaft part in the first step at a relatively small resistance to screwing on, which increases when the intermediate position is reached, this position being for example located at between ⅓ and ⅔, preferably half, the total travel of screwing on, with the result that the user receives an indication that he or she still has to screw the cap on further and preferably as far as the end position, with the increased resistance to screwing on also resulting in the cap being held more reliably in this screwed-on position, preferably in the end position, and not coming away from its seating in an undesirable manner.

The relatively large resistance to screwing on may be created by a spring device acting on the cap. This spring device includes for example a spring which acts in the axial direction of the shaft part, for example in the form of a corrugated spring disk. In this way, the threaded portions of the shaft part and the cap which come into engagement with one another may be constructed over their entire lengths such that the friction acting between them as a result of the thread engagement is substantially the same, while the increased screwing-on resistance is brought about by the spring device, which only becomes active when the intermediate position is reached. A spring device of this kind is subject to substantially less wear than, for example, threaded portions, which are exposed to increased friction when they engage with one another, as a result of appropriate shaping.

The spring device may include a support ring which can be displaced axially in opposition to the spring force and with which the cap comes into engagement in the intermediate position, with the result that as screwing on of the cap is continued the support ring is moved away from an abutment shoulder of the shaft part, in opposition to the force of the spring.

The end position may be formed for example by the abutment of a stop face, for example the end face of the cap that surrounds the cap opening, against a shoulder of the shaft part.

The invention will be explained in more detail below with reference to the figures, which diagrammatically show an exemplary embodiment.

FIG. 1 shows, partially in section, a fountain pen with the cap screwed on.

Figure 1:
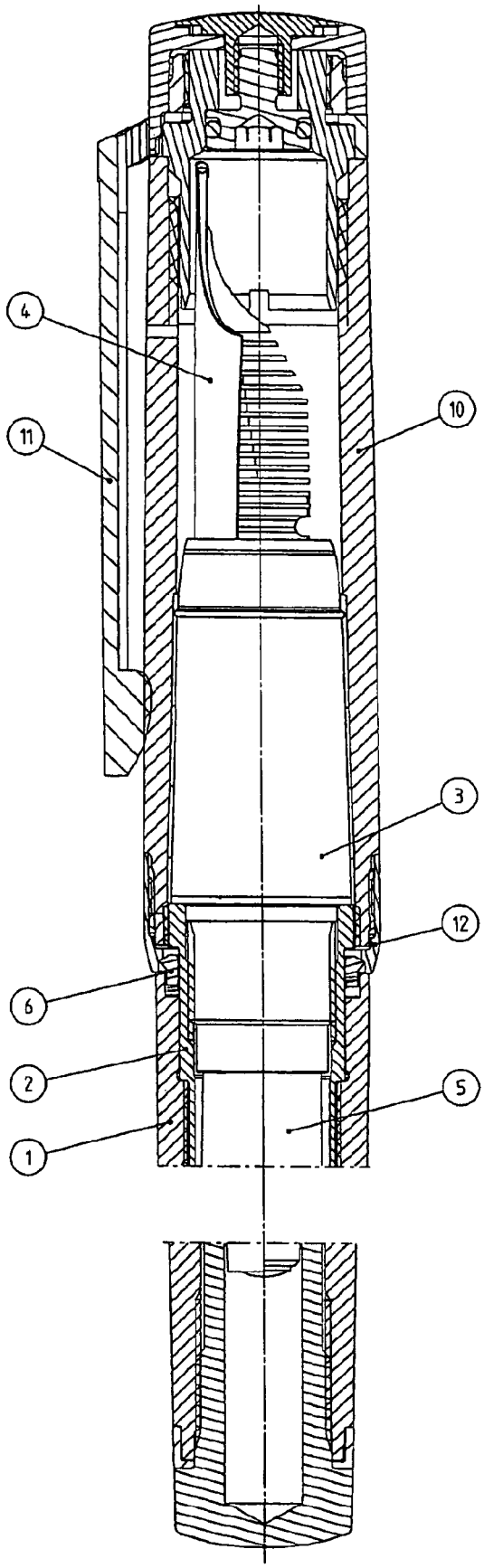

The fountain pen illustrated in FIG. 1 includes a shaft part comprising a tubular container 1 which is closed in conventional manner at the rear end and into the front end whereof a threaded sleeve 2 is screwed, the latter for its part containing in conventional manner an internal thread for receiving the ink feed 3 that carries the writing nib 4, an ink cartridge 5 being pushed onto the rear end of this ink feed 3.

The threaded sleeve 2 has an external thread on its part projecting out of the container 1, and the cap, which includes a cap element 10 to which a clip 11 is secured in conventional manner, is screwed onto this external thread. To increase the strength of the screwing-on end of the cap element 10, a cap ring 12 made of metal is mounted thereon and ends in a front end face 13.

A construction of this kind is conventional in fountain pens and indeed in other writing implements.

Figure 2:
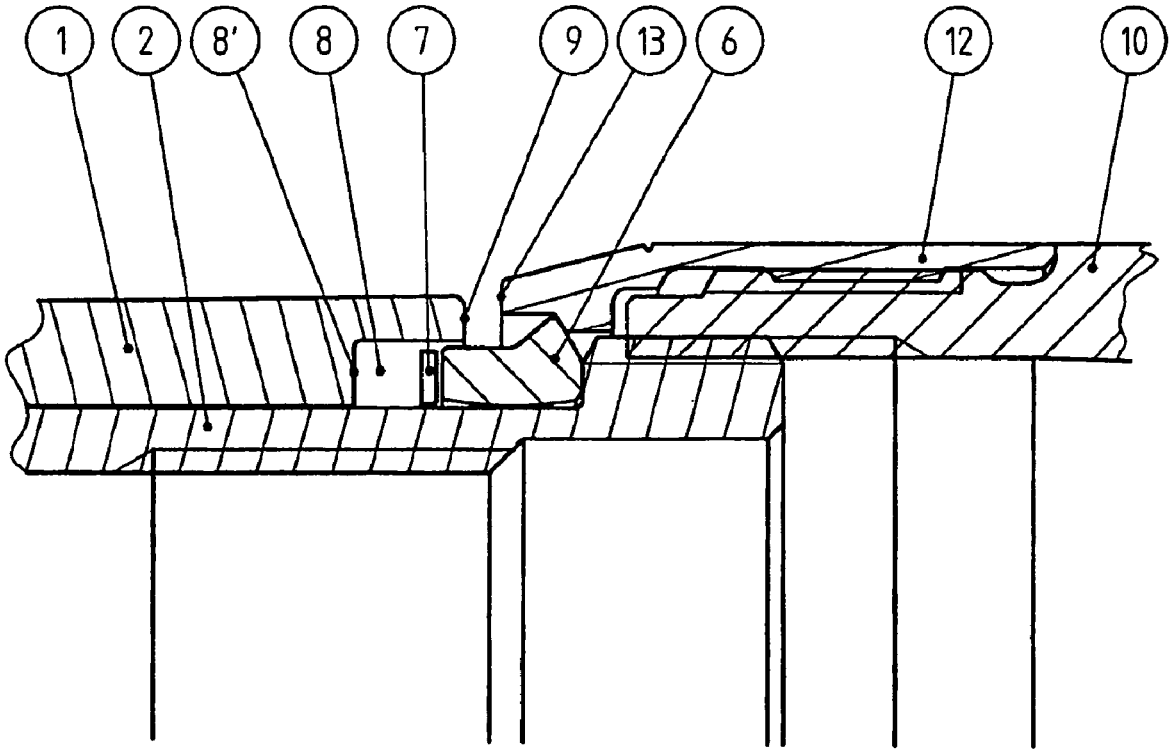
FIG. 2 shows, in a simplified partial illustration, the engagement region of the shaft part and the cap of the fountain pen from FIG. 1, with the cap, which is in section, screwed on as far as the intermediate position, and with the ink feed and the ink cartridge omitted.
Figure 3:
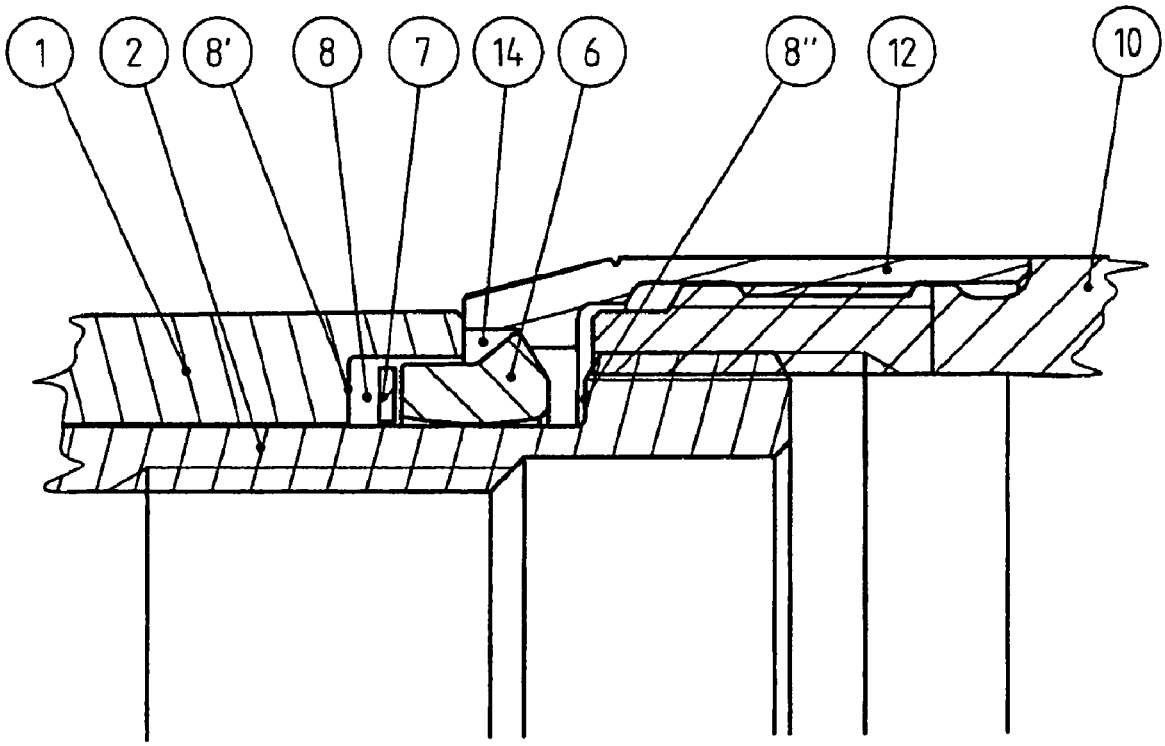
FIG. 3 shows, in an illustration corresponding to FIG. 2, the cap screwed on as far as the end position.

As is particularly seen from FIGS. 2 and 3, an annular space 8 is formed on the shaft part between the container 1 and the threaded sleeve 2, and this annular space 8 extends at the front end, that is the end closer to the external thread for screwing on the cap, as far as an annular shoulder 8" (FIG. 3) and, at the rear end, as far as an annular shoulder 8' from which the container 1 extends forward to partly cover the annular space 8. A corrugated spring disk 7 is inserted into the annular space 8 and is supported on one side against the rear annular shoulder 8' of the annular space and on the other against a support ring 6, which is located in the annular space 8 and, when the cap is not screwed on or not screwed as far as the intermediate position, is held in abutment against the front annular shoulder 8" by the force of the spring disk 7. The internal diameter of the support ring 6 is slightly larger than the external diameter of the threaded sleeve 2 in the region of the annular space 8, with the result that the support ring can be moved to and fro on the threaded sleeve. In the front region, the support ring 6 has a radially outwardly projecting peripheral rib region or a shoulder.

If the cap is screwed onto the external thread of the threaded sleeve 2 of the shaft part by means of its internal thread on the cap part 10, first of all the two threads reach a first engaged position, and the thread engagement increases as the cap is screwed further on, and after a certain time the radially outwardly projecting rib region of the support ring 6 enters an annular recess 14 (FIG. 3) in the cap ring 12. The annular shoulder, which inwardly delimits the recess 14, eventually comes into abutment against the support ring 6, as illustrated in FIG. 2. This engagement defines the intermediate position for the screwed-on condition of the cap. Then, as the cap is screwed further on, as a result of the engagement between the cap ring 12 and the support ring 6, and the resulting axial displacement of the support ring, the spring disk 7 is compressed, producing a resistance to screwing on which acts in the axial direction of the shaft part, that is to say the resistance to screwing on becomes greater, in a manner noticeable to the user, than the resistance which applied during screwing on from the first engaged position to the intermediate position.

The cap has been screwed on as far as its end position once the end face 13 of the cap ring 12 has come into abutment against the end face 9 of the container 1 of the shaft part (FIG. 3). In this position, the cap is held loaded in the axial direction by the action of the spring disk 7, with the result that the risk of the cap inadvertently coming off is significantly reduced.

The invention claimed is:

1. A writing implement having a shaft part, on which a writing tip is mounted, and a cap that can be screwed onto the shaft part from a first engaged position to an end position, for covering the writing tip, wherein when the cap is screwed on there is a resistance to screwing on the cap from an intermediate position, which is located between the first engaged position and the end position, until the end position is reached, this resistance being greater than the resistance when the cap is screwed on from the first engaged position to the intermediate position, wherein the greater resistance is created by a spring device acting on the cap, and wherein the spring device includes a spring which acts in the axial direction of the shaft part and a support ring which can be displaced axially in opposition to a spring force of the spring and with which the cap comes into engagement in the intermediate position, with the result that as screwing on continues, the support ring is moved away from an abutment shoulder of the shaft part, in opposition to the spring force.

2. The writing implement as claimed in claim 1, wherein the spring is in the form of a corrugated spring disk.

3. The writing implement as claimed in claim 1, wherein the end position is formed by the abutment of a stop face of the cap against a shoulder of the shaft part.

4. The writing implement as claimed in claim 3, wherein the stop face is an end face that surrounds the cap opening.

5. A writing implement comprising:

a shaft part on which a writing tip is mounted at one end;

a cap threadedly securable to the shaft part; and a spring device coupled with the shaft part and including a support ring displaceable between a neutral position and a compressed position based on an engagement position of the cap on the shaft part, wherein the support ring is positioned relative to the cap and the shaft part such that the support ring maintains the neutral position when the cap is screwed from a first engaged position to an intermediate position and such that the support ring is displaced relative to the shaft part from the neutral position to the compressed position as the cap is screwed from the intermediate position toward an end position.

6. The writing implement as claimed in claim 5, wherein the spring device comprises a spring that biases the support ring toward the neutral position, and wherein the shaft part includes a shoulder defining an annular space in which the spring and the support ring are disposed surrounding the shaft part.

* * * * *